US006044498A

United States Patent [19]

Schumann et al.

[11] Patent Number: 6,044,498

[45] Date of Patent: Apr. 4, 2000

[54] SLASH AND CUT RESISTANT GARMENTS FOR PROTECTING A PERSON FROM INJURY

[75] Inventors: Erhardt Friedrich Schumann, Burlington; Randall D. Templeton, Kitchener; George Malcolm Fingland, Kingston, all of Canada

[73] Assignee: E. I. du Pont Nemours and Company, Wilmington, Del.

[21] Appl. No.: 09/189,598

[22] Filed: Nov. 10, 1998

Related U.S. Application Data

[60] Provisional application No. 60/069,822, Dec. 16, 1997.

[51] Int. Cl.[7] ..... A41D 13/00

[52] U.S. Cl. ..... 2/468; 2/2.5

[58] Field of Search ..... 66/202; 2/455, 2/456–459, 461–468, 2.5, 2.11, 44, 45, 102, 103, 129, 159, 167, 161.7; 442/304, 306

[56] References Cited

U.S. PATENT DOCUMENTS

| | | | |
|---|---|---|---|
| D. 268,142 | 3/1983 | Livernois . | |
| D. 329,508 | 9/1992 | Fair . | |
| D. 398,719 | 9/1998 | Ferguson et al. . | |
| 4,100,620 | 7/1978 | Pecoraro . | |
| 4,324,003 | 4/1982 | Johnston . | |
| 4,370,754 | 2/1983 | Donzis . | |
| 4,449,251 | 5/1984 | Gauthier . | |
| 4,453,271 | 6/1984 | Donzis . | |
| 4,472,472 | 9/1984 | Schultz . | |
| 4,686,710 | 8/1987 | Marston et al. . | |
| 4,856,110 | 8/1989 | Giesick . | |
| 4,912,781 | 4/1990 | Robins et al. | 2/167 |
| 4,918,912 | 4/1990 | Warner . | |
| 5,023,953 | 6/1991 | Bettcher | 2/126 |
| 5,050,406 | 9/1991 | Strauss et al. | 66/177 |
| 5,070,540 | 12/1991 | Bettcher et al. | 2/2.5 |
| 5,168,576 | 12/1992 | Krent et al. . | |
| 5,198,288 | 3/1993 | Grunfeld | 428/253 |
| 5,210,877 | 5/1993 | Newman | 2/115 |
| 5,233,821 | 8/1993 | Weber, Jr. et al. . | |
| 5,245,706 | 9/1993 | Moschetti et al. . | |
| 5,316,820 | 5/1994 | Harpell et al. . | |
| 5,399,418 | 3/1995 | Hartmanns et al. | 428/218 |
| 5,442,815 | 8/1995 | Cordova et al. . | |
| 5,472,769 | 12/1995 | Goerz et al. | 428/138 |
| 5,721,179 | 2/1998 | Shi et al. . | |
| 5,858,054 | 1/1999 | Rosen | 66/202 |

FOREIGN PATENT DOCUMENTS

| | | |
|---|---|---|
| 1053402 | 5/1979 | Canada . |
| WO 97/07859 | 3/1997 | WIPO . |

*Primary Examiner*—Gloria M. Hale
*Assistant Examiner*—Tejash Patel

[57] ABSTRACT

A slash and cut resistant garment for protecting a person from injury by slashing or cutting with a blade, knife or other sharp edged device, which garment is shaped to fit and be removably secured to at least a portion of the person's body that requires protection from injury, the garment comprising in its body protection areas, a major portion of a slash and cut resistant fiber knitted with a minor portion of a stretch fiber, the weight, knit and layers of fabric being selected according to the degree of slash and cut resistance required for the garment. In its most particular form, the invention is a neck protector and the slash and cut resistant fabric covers the neck of the person and extends downwardly to cover a portion of the collarbones and upwardly around the neck to a position that is just below the chin and has the shape of a turtleneck garment or dickey.

9 Claims, 1 Drawing Sheet

SLASH AND CUT RESISTANT GARMENTS FOR PROTECTING A PERSON FROM INJURY

This application claims the benefit of U.S. Provisional Application Ser. No. 60/069,822, filed Dec. 16, 1997.

FIELD OF THE INVENTION

The present invention relates to a protective garment to be worn by a person who requires protection from injury by slashing or cutting with a blade, knife or other sharp edged device. Typically the garment is worn by an ice skater, in particular a hockey player who is exposed to potential injury during a game of hockey. The garment, in its most preferred form, is a knitted throat and neck protector which is sufficiently cut and slash resistant so as to protect against lacerations to the neck area caused by a skate blade or hockey stick.

BACKGROUND OF THE INVENTION

When playing sports such as hockey, fatal accidents often occur when players collide on the ice. Often when a player is trying to avoid collision with another player who has fallen down, a player quickly steps over a fallen player, and in so doing may place the blade of his/her skate in contact with the throat or neck of the fallen player which can result in injury to the carotid artery or jugular vein of the fallen player and possible subsequent death.

Throat protection has been proposed previously for hockey players, an example of which is found in U.S. Pat. No. 4,686,710 issued Aug. 18, 1987 to Marsten et al. The sports protector of this patent is an elongated, substantially flat armour member adapted to be positioned about the neck of a wearer and shaped to cover the vital areas of the wearer's throat. The armour member is made of flexible slash-resistant material have a slash-resistance of at least about 120 lbs. The device includes means fixed to the armour member to enable the member to be retained in a protective shape over the vital throat areas of the wearer. While this protector has gained wide acceptance, it is generally not considered to be very comfortable and often players don't wear it correctly so that it functions to protect them. Its drawbacks include: that it is relatively rigid and therefore uncomfortable, it tends to be very warm when worn during play, and it restricts movement and bending of the neck.

The prior art sports neck protector described above includes slash-resistant material that may be a seamless knitted fabric constructed of threads each having a flexible metallic core encased in a high strength textile fibre wrapping. However, even though the structure may incorporate a knitted fabric, the overall design is such that the fabric does not add suitable flexibility or sufficient comfort to the article.

Other examples of protective sports clothing are described in U.S. Pat. No. 4,449,251 issued May 22, 1984 to Gauthier (Neck and Collarbone Protection); U.S. Pat. No. 4,324,003 issued Apr. 13, 1982 to Johnston (Throat Guard); U.S. Pat. No. 5,233,821 issued Aug. 10, 1993 to Weber, Jr., et al (Protective Garment Containing Polybenzazole); U.S. Pat. No. 4,856,110 issued Aug. 15, 1989 to Giesick (Athletic Protective Safety Sock); U.S. Pat. No. 4,918,912 issued Apr. 24, 1990 to Warner (Cut and Abrasion Resistant Spun Yarns and Fabrics); U.S. Design Pat. No. 268,142 granted Mar. 8, 1983 to Livernois (Protective Garment for an Ice Hockey Player, Pants); U.S. Design Pat. No. 398,719 granted Sep. 22, 1998 to Ferguson, et al (Mesh Neck Protector); and U.S. Design Pat. No. 329,508 granted Sep. 15, 1992 to Fair (Neck, Chest and Shoulder Protector).

Commercial hockey neck protectors generally have a foam layer or other material to provide stiffening to keep the protection in place on the neck, and thus the problems of the design of stiffness and heat build-up exist for the wearer.

There is a need for a garment that is comfortable, does not produce heat buildup for the wearer during play and provides the required neck protection for hockey players.

While knitted fabrics and garments are known, and it is known to knit slash-resistant fibre, to date, no one has developed the right combination of fibre and fabric construction to provide an acceptable form of comfortable, fashionable and versatile neck protection for skaters with the required degree of slash and/or cut protection.

SUMMARY OF THE INVENTION

The present invention provides a slash and cut resistant garment for protecting a person from injury by slashing or cutting with a blade, knife or other sharp edged device, which garment is shaped to fit and be removably secured to at least a portion of the person's body that requires protection from injury, the garment comprising in its body protection areas, a major portion of a slash and cut resistant fibre knitted with a minor portion of a stretch fibre, the weight, knit and layers of fabric being selected according to the degree of slash and cut resistance required for the garment.

Preferably, the major portion of the slash and cut resistant fibre comprises from about 90% to about 97% by weight of the fabric and the minor portion of the stretch fibre comprises from about 3% to about 10% by weight of the fabric.

In another preferred form of the invention, the garment includes a wicking and moisture management fibre knitted into the fabric or as a layer of the fabric or garment. Alternatively cotton or polyester or nylon fibres may be used separately or in combination to one or more layers of the garment.

In a preferred form of the invention, there is provided a slash and cut resistant knitted garment as described above wherein the garment is a neck protector and the slash and cut resistant part of the garment covers at least the neck of the person and extends downwardly to cover a portion of the collarbones and upwardly around the neck to a position that is just below the chin so that it has the shape of a turtleneck garment or dickey.

Most preferably, the garment is a knitted turtleneck garment or a knitted dickey garment that includes a knitted fabric comprising slash and cut resistant fibre knitted with a stretch fibre in areas of the garment that cover the vital throat and neck areas of the wearer.

The neck protector may comprise a multilayer structure that comprises at least two layers of knitted slash-resistant fibre knitted together with a stretchable fibre and an outside covering layer of wicking and moisture management fibre optionally knitted with stretchable fibre or an outside covering layer of cotton fibre optionally knitted with stretchable fibre or an outside covering layer of polyester fibre optionally knitted with stretchable fibre.

As will be apparent, the garment of the present invention may be provided in fashion colours or team uniform colours and may have printed designs or text applied to it as required. Alternatively the knit pattern may be selected to provide a design as is known to those skilled in the art.

The knitted slash and cut resistant fabric may also be combined with solid material that may be characterized as armoured parts that provide additional protection to body areas, such as shins, thighs, knees, elbows and the like. In such instance, the knitted fabric will provide a level of comfort not previously found in other prior art or known garments.

The slash-resistant fibre used in the garment of the present invention may be selected from aramid fibres, high density polyethylene fibres, PBO fibres and other high performance specialty fibres such as those available commercially under the brands KEVLAR®, TWARON®, DYNEEMA®, TECHNORA®, SPECTRA®, SURTRAN® and VECTRAN®. Preferred is KEVLAR® brand aramid.

The stretchable fibre used in the present invention may be selected from spandex type fibres, of which LYCRA® brand spandex is preferred, although other spandex products are equally suitable. The wicking and moisture management fibre may be selected from tetrachannel polyester fibres such as COOLMAX®. Again other commercially available fibres may be selected. Polyester, cotton, nylon and cotton fibres that are specially treated to have such properties may also be used in the garment. Such fibres are well known in the art and may be used alone or in combination and with spandex fibre, if desired.

The techniques used to knit the fabrics of the present invention are those well known in the art.

It is well known that LYCRA® brand spandex may be used with cotton, cotton blends, or textured nylon to produce fabrics with appropriate stretch and recovery power, which in turn provide comfort for the wearer. Such fabrics could be used as the outer covering layer in the structure of the present invention. The introduction of LYCRA® brand spandex into a knitted fabric may comprise any of the following forms: bare, covered and core spun. The techniques used to incorporate such fibres into fabric are well known and detailed in the art and hence the person skilled in the art can readily determine the techniques required for such construction.

For specific knitting techniques which may be used to make the fabric of the invention, reference may be had to DuPont Canada Inc. Bulletins Lycra® Spandex in Circular Knit Underwear Leg Bands, March, 1978 and Lycra® in Circular Knit Fabrics, TSB-L-14, September, 1973, the disclosures of which are incorporated herein by reference. The desired weight and fibre content of the fabric will influence the type of knitting machine selected to manufacture the fabric and the person skilled in the art may easily select the appropriate combination.

The knitted fabric produced may have a rib construction or a single knit construction or a double knit construction. In a double knit construction, the KEVLAR® brand aramid may be on the inside of the fabric, while cotton or a COOLMAX® brand polyester fabric may be on the outside, with LYCRA® brand spandex being combined in both layers of the double knit fabric.

When KEVLAR® brand aramid and cotton are used in combination with LYCRA® brand spandex to produce the fabrics of the present invention, typically the KEVLAR® brand aramid fibre and the cotton each comprise about 12 oz. fabric. Typically the fabric weight may comprise from 6–7 oz., with 6.5 oz. being preferred.

The garment of the present invention may be constructed to permit the incorporation of garment adjustment capability, either by the production of multi-sizes, such as x-small, small, medium, large and x-large, for example, or by virtue of adjustment means such as, for example VELCRO® brand closures which permit quick and easy adjustment, as well as rapid dressing and undressing by the wearer. Overlapping ends are required for any closure to ensure that no exposure of the neck results in the area around the closure.

In the field of hockey, the national standard of Canada with respect to neck protectors for hockey players is determined by the Bureau de Normalization du Quebec or BNQ and is approved by the Standards Council of Canada. Every neck protector approved for use by hockey players regardless of their age must be approved by this entity. The standard in question is entitled CAN-BNQ 9415-370-1976 and any updates thereto are included herein. The purpose of the standard is to specify the characteristics of neck protectors worn by hockey and ringette players and designs to ensure that reduce the risk of direct lacerations on the neck caused by contact with a skate blade in the area covered by the neck protector. In accordance with the standard, neck protectors must be produced in a variety of sizes in order to fit the variety of persons who are required to be outfitted with this type of garment.

This standard test requires that certain skate blade slash resistance be provided by the garment.

Test Procedure

In the procedure, the neck protector to be tested is attached to an artificial foam neck so that a skate blade can enter into contact with the part of the neck protector to be tested. Pressure is applied so that the neck protector is propelled toward the skate blade at a required speed. Once concluded, the neck protector is removed and a check is made as to whether there are any cuts on the artificial foam neck. Three tests of the neck protector are required at three different locations. One of these locations is the junction between the upper and lower parts of the neck protector if the product comprises an assembly of two parts. Not more than one test may be carried out at the given spot on the artificial neck foam and the foam must be replaced for each protector tested.

Interpretation of Results

Nine tests are carried out on each model of neck protector and if one cut is detected on the artificial neck foam, the model being tested is deemed not to conform to standard. If the layer of the neck protector that is in contact with the skin of the user is not intact, the neck protector is rejected as not conforming to the standard.

If a cut area reaches the bottom layer of the neck protector without altering it, three additional tests are carried out over the same area of a new neck protector, but without having to change the skate blade used for the first nine tests. The success criteria remain as described previously.

The neck protector design of the present invention succeeds in meeting the BNQ standard, as well as allowing a player to wear the neck protector comfortably and confidently.

BRIEF DESCRIPTION OF THE DRAWINGS

In the accompanying drawings which are used to illustrate the present invention and which should not be used to limit the scope of the appended claims.

DETAILED DESCRIPTION OF THE INVENTION

Figure 1:
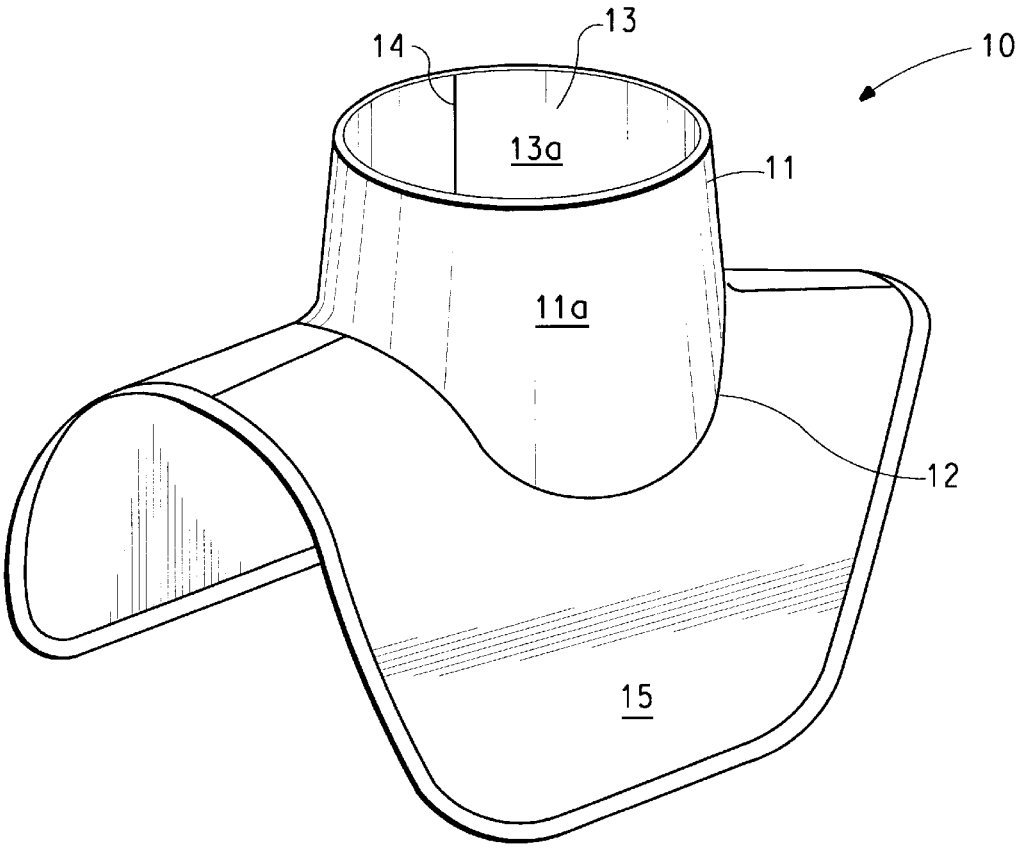
FIG. 1 is a perspective view of a neck protector comprising a dickey.
Figure 2:
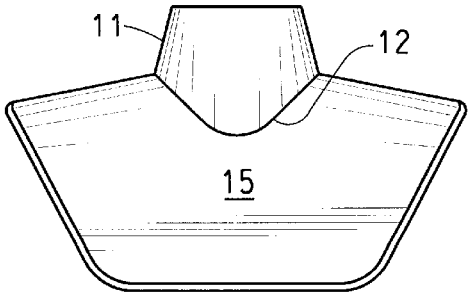
FIG. 2 is a front view of the neck protector shown in FIG. 1 of the present invention.
Figure 3:
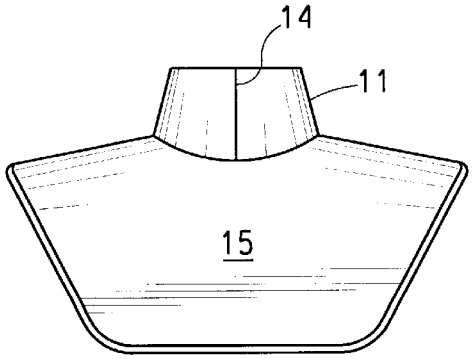
FIG. 3 is a rear view of the neck protector shown in FIG. 1.

Single knit fabric may be used for garments that are for protection of body parts such as arms, legs and torsos. Thus it is proposed that socks of varying lengths be constructed of a knitted fabric comprising KEVLAR® and LYCRA® brand fibres in the proportions mentioned earlier for such garments. Garments may be in the form of longjohns, long underwear or a body stocking.

Where the garment is a neck protector, then double knit fabrics or multilayer fabrics are preferred. The garment may comprise a turtlenecked shirt or sweater, or a dickey.

In a preferred form of the present invention, the throat protection part of the garment comprises two layers of an aramid/spandex fabric or a cotton/aramid/spandex fabric covered by one or more layers of a cotton/spandex fabric. The outer or covering layer may comprise a single layer that is simply wrapped over the two slash resistant layers. The two layers of slash resistant/stretch fabric could be replaced with a single layer of such fabric that is of sufficient weight to provide similar protection as the two layers of fabric. The layer or layers of cotton-spandex fabric may protect the aramid fabric from UV degradation and abrasion from whiskers. In addition, this outer covering layer allows for the garment to be dyed or printed as required.

Referring now to the accompanying drawings, a dickey is shown generally at 10, which is constructed in accordance with the present invention. The dickey 10 comprises a circular neck portion having an outside layer 11 with surface 1 la and an inside layer 13 with surface 13*a* and a shoulder portion 15 that lies on the shoulders of the wearer and helps secure the garment in place. As shown at 12, the front part of the round neck portion extends downwardly so that when placed upon the wearer, this slash and cut resistant part of the garment covers the sensitive region of the throat, in particular it extends far enough below the clavicle of the wearer so as to protect this part of the body from injury. The outer surfaces 11*a* and 13*a* are continuous in this design as they constitute a covering layer which may be made of combinations of wicking and moisture control fibre with spandex fibre or cotton fibre with spandex fibre or polyester fibre with spandex. This layer offers comfort to the wearer and the inner layer or layers of slash resistant fibre and spandex may be protected from whisker damage and UV exposure, if require.

EXAMPLE

A fabric was produced using yarns that are 1/30's cc (Cotton Count) spun KEVLAR® yarn (spun by Cavalier Textiles in Canada) knit with 70 den. (78D'tex)type 162C LYCRA®. This fabric was knit on a 14 cut, 72 feed 30" diameter rib knitting machine made by Orizio.

Fabric Content: 3.0% LYCRA®97% KEVLAR®

Fabric Weight: 6.26 oz./sq. yard or 213 gms./sq. meter

The invention may be varied in any number of ways as would be apparent to a person skilled in the art and all obvious equivalents and the like are meant to fall within the scope of this description and claims. The description is meant to serve as a guide to interpret the claims and not to limit them unnecessarily.

We claim:

1. A comfortable, self-supporting neck protector for an ice hockey player comprising a knitted turtleneck or dickey that includes slash and cut resistant fabric providing resistance to cuts and slashes from a skate blade, which neck protector comprises an upstanding cylindrical neck portion and a yoke portion covering vital throat areas of the player and comprises a multilayer fabric structure comprising at least one layer of slash and cut resistant fabric comprising a slash and cut resistant fibre knitted together with a stretchable fibre, said at least one layer being covered completely by an outside layer comprising a knitted fabric made from at least one fibre selected from wicking and moisture management fibres, cotton fibres, polyester fibres and nylon fibres and blends thereof, and optionally a stretchable fibre.

2. The neck protector of claim 1 wherein the slash and cut resistant fibre comprises from about 90% to about 97% of the slash and cut resistant fabric layer and the stretch fibre comprises from about 3% to about 10% by weight of the slash and cut resistant fabric layer.

3. The neck protector as claimed in claim 1 wherein the multilayer structure comprises two layers of knitted slash resistant fabric and an outside covering layer of fabric comprising at least one fibre selected from polyester, nylon and cotton fibres and blends thereof, and optionally a stretch fibre.

4. The neck protector as claimed in claim 3 wherein the slash resistant fibre is selected from aramid fibres and the stretchable fibre is selected from spandex fibres.

5. The neck protector as claimed in claim 1 wherein the garment also includes a wicking and moisture management fibre knitted into the outside fabric layer or as an extra layer of the multilayer fabric structure.

6. The neck protector as claimed in claim 1 having a reclosable opening for allowing rapid dressing and undressing by the skater.

7. The neck protector as claimed in claim 1 having size adjustment means.

8. The neck protector as claimed in claim 1 wherein there is provided a cut through portion of the protector, which does not have the at least one layer of slash and cut resistant fabric, which portion extends vertically through the back of the neck to permit rapid removal of the neck protector in an emergency.

9. The neck protector as claimed in claim 1 wherein there are two layers of slash and cut resistant fabric.

* * * * *